United States Patent [19]

Chambon et al.

[11] 4,445,785

[45] May 1, 1984

[54] ELECTRONIC TIME SETTING FOR A QUARTZ ANALOG WATCH

[75] Inventors: Jean P. Chambon, Montfaucon; Jean-François Dufay; Paul Grand Chavin, both of Besançon; Georges J. Perrin, Thise; Louis Vernay, Besançon, all of France

[73] Assignee: William C. Crutcher, Waterbury, Conn.

[21] Appl. No.: 397,638

[22] Filed: Jul. 12, 1982

[51] Int. Cl.[3] ..... G04C 9/00; G04F 5/00

[52] U.S. Cl. ..... 368/187; 368/157

[58] Field of Search ..... 368/76, 80, 85-87, 368/155-157, 160, 185, 187, 188, 69-70, 368/217-219; 318/696

[56] References Cited

U.S. PATENT DOCUMENTS

| | | | |
|---|---|---|---|
| 4,205,519 | 6/1980 | Deruns | 368/73 |
| 4,259,737 | 3/1981 | Berney | 368/66 |
| 4,275,463 | 6/1981 | Ishida | 368/187 |
| 4,349,900 | 9/1982 | Aizawa | 368/187 |

*Primary Examiner*—Vit W. Miska

*Attorney, Agent, or Firm*—William C. Crutcher; Joseph A. Biela

[57] ABSTRACT

An electronic analog timepiece with time zone and time setting modes selected by appropriate rotation and axial movement of a crown that controls a high speed stepping motor is disclosed. The stepping motor provides high frequency signals to produce time correction rotation of the timepiece hands. The speed of the stepping motor is reduced by a deceleration ramp from high speed prior to stopping the motor at the end of time correction. The time setting mode may be selected when the watch is in the shutdown mode and the time zone mode is selected when the watch is in the normal clockwise running mode by rotating the crown in either the clockwise or counterclockwise direction. The shutdown mode may be selected from the normal running mode by pulling the crown to its out/setting position and the normal running mode may be selected from the shutdown mode by pushing the crown to its on/run position. Time setting mode includes as a first option a slow time correction speed in which the hour and minute hands advance step by step at a frequency of 1 Hz followed by automatic high speed correction of the hands at a speed which is a whole number multiple of the slow correction speed until the crown is released. As a second option, the time setting mode begins with the slow time correction speed followed by a high speed hour hand correction performed by the time zone function when the watch is in its normal running mode. The motor obtains high speed at the end of an acceleration ramp. After time correction is completed, the second hand will be in its initial position.

2 Claims, 6 Drawing Figures

ELECTRONIC TIME SETTING FOR A QUARTZ ANALOG WATCH

BACKGROUND OF THE INVENTION

The present invention relates to an analog timepiece having two forward and reverse time correction functions utilizing a high speed stepping motor.

Quartz timepieces that have analog displays include a crystal controlled oscillator and a stepping motor display driver. In order to provide for time correction, a correction control member such as a crown had to be positioned and rotated to produce movement of the hands of the timepiece in response to impulses provided by the stepping motor.

In U.S. Pat. No. 4,192,134 issued to Yoshida, an electronic analog timepiece was disclosed in which a forward and reverse time correction operation is performed with the use of a single correction switch. The switch could also provide for rapid time correction within a short time period. A push button is used for time correction switching.

U.S. Pat. No. 4,112,671 issued to Kato et al. discloses fast time correction to prevent the standard time from gaining during time correction.

Generally, timekeeping signals actuate drive circuits to provide drive pulses of selected wave shapes to drive a stepping motor which turns hour, minute and sometimes second hands. The drive pulses may be repetitive wave shapes of the same polarity for driving stepping motors as disclosed in U.S. Pat. No. 3,818,690 issued to Schwarzschild and U.S. Pat. No. 4,070,279 issued to Oudet et al. which are incorporated herein by reference. Alternately, the stepping motor may be of the type receiving pulses of alternating polarity as described in the patent issued to Kato et al. described above.

Movement of the hands can be acclerated during time correction and driven at various speeds in both the forward and reverse directions. Examples of this type of time correction function are disclosed in U.S. Pat. No. 4,173,863 issued to Motoki and U.S. Pat. No. 4,030,283 issued to Sauthier.

It is also known to use a single push button switch for controlling various time setting modes for a digital watch as illustrated in U.S. Pat. No. 3,953,964 issued to Suppa. U.S. Pat. No. 4,192,134 issued to Yoshida shows a single push button that achieves alternating forward and backward hand movement for time correction. One time correction problem associated with quartz analog stepping motor watches is that the watch timekeeping is disturbed if time zone changes are made during which the hour hand is repositioned. In the Motoki patent, previously discussed, one hour time correction may be performed but the watch must be reset by advancing the hands at a slower rate once the hour hand moves ahead or moves back by one hour.

Additional patents involving time correction means include U.K. patent application No. 2,070,816 A issued to Mouthon et al., U.S. Pat. No. 4,199,932 issued to Berney, U.S. Pat. No. 4,092,822 issued to Droz et al., U.K. patent application No. 2,032,145 A issued to Jaunin, U.S. Pat. No. 3,928,959 issued to Naito, U.S. Pat. No. 4,196,578 issued to Besson, U.S. Pat. No. 4,143,509 issued to Weibel, and U.S. Pat. No. 4,275,463 issued to Ishida.

Accordingly, it is an object of the invention to produce high speed time correction of the minute, hour and second hands using a high speed stepping motor.

It is an object of the invention to provide for a deceleration from fast time correction within a predetermined time prior to the end of either of two time correction functions.

Another object of the invention is to automatically provide for an adjustment of time correction as the stepping motor decelerates by the amount of time required for correction to occur so that the actual timekeeping of the watch is not disturbed.

An additional object is to provide two circuits one for time zone and the other for time setting correction functions where each circuit produces time correction in both the forward and reverse directions.

SUMMARY OF THE INVENTION

An electronic analog timepiece which has two time correction circuits where each provides time correction signals that produce clockwise or counterclockwise rotaton of at least one of the hands of the timepiece when the timepiece is in either the shutdown mode or the normal running mode of operation. The analog timepiece includes a multiple position switch, preferably actuated by the crown, that is used to independently select one of the operating modes from which one of the time correction circuits can be controlled to provide for time correction. A stepping motor controller responds to the signals provided by either by the time correction circuits and produces at least one series of impulses for controlling the speed with which the high speed stepping motor produces time correction rotation of at least one of the hands of the timepiece. An acceleration ramp provides controlled increase in pulse frequency to increase the speed of the stepping motor. A deceleration ramp which is responsive to the signals produced by the time correction circuits reduces the speed of the high speed stepping motor and is started by counter means prior to the stopping of the high speed stepping motor.

DESCRIPTION OF THE PREFERRED EMBODIMENT

Figure 1A:
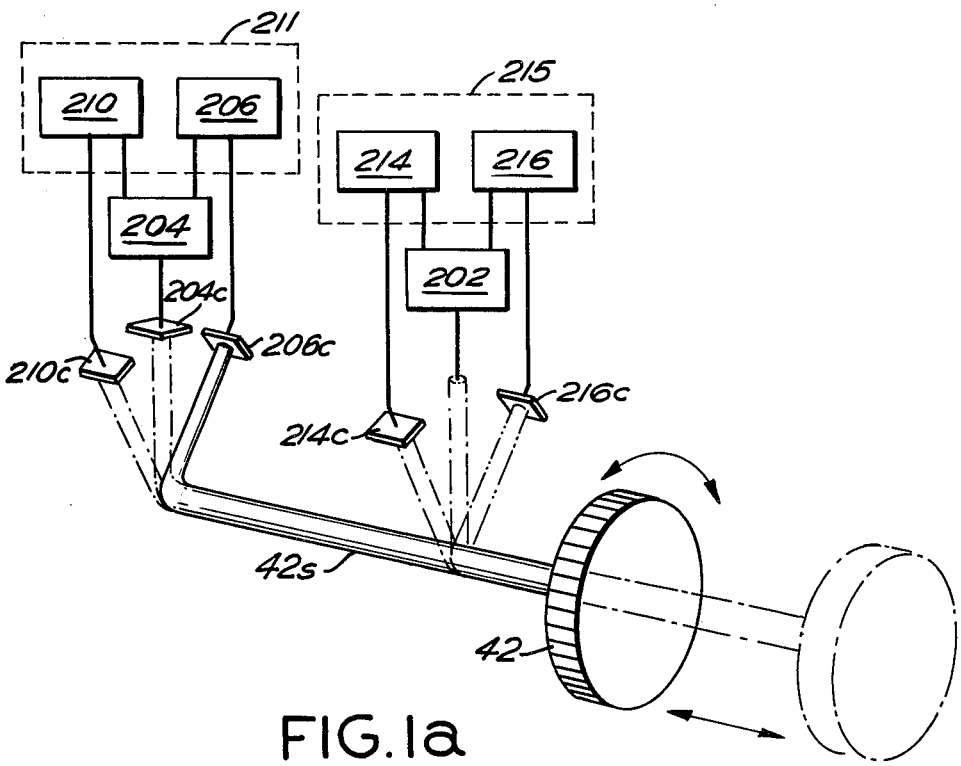
FIG. 1*a* is a block diagram showing switch movements for selecting time modes in accordance with the invention.

Referring now to FIG. 1*a,* the timepiece switch or crown operated switch 42 and attached stem 42*s* are shown in the various rotational and axial positions for selecting time zone mode 211, time setting mode 215, normal running mode 204 and shutdown mode 202. As indicated by the arrows, the crown and shaft can be moved axially and rotated in either the clockwise or counterwise directions as required for selecting the desired time mode. In terms of just crown movement, when crown operated switch 42 is pushed in, stem 42*s* engages contact 204*c* to put the watch in normal running mode 204. From the normal running mode, the watch may be put into the time zone setting mode 211 but only if crown 42 is rotated either clockwise or counterclockwise. By rotating crown clockwise to allow stem 42*s* to engage contact 206*c* for a predetermined amount of time, the time zone mode will be entered to allow for time zone setting to occur in the reverse or counterclockwise direction 206. By rotating crown 42 in the counterclockwise direction to allow stem 42*s* to engage contact 210*c* for a predetermined period of time, the time zone mode will again be entered but to provide the zone setting in the forward or clockwise direction 210. Once the time zone change has occured in either the forward or reverse direction, the watch automatically terminates the time zone setting mode and reenters the normal running mode.

Pulling crown 42 axially takes the watch out of normal running mode 204 and places it in shutdown mode 202 wherein stem 42*s* does not engage any contact. However, once in the shutdown mode, the watch can be put in the time setting mode by rotating the crown either clockwise or counterclockwise. By rotating the crown clockwise, stem 42*s* engages contact 216*c* for producing reverse time correction in the time setting mode 216. Rotating the crown counterclockwise allows stem 42*s* to engage contact 214*c* for providing forward time correction in the time setting mode 214. Time correction occurs for as long as the crown is held in either the clockwise or counterclockwise rotated position. The shutdown mode 202 is obtained from time setting mode 215 upon releasing the crown from its clockwise or counterclockwise rotated position. The shutdown mode is not automatically obtained from the time setting mode. Normal running mode 204 is obtained from shutdown mode 202 by pushing the crown axially to allow stem 42*s* to engage contact 204*c*. From the normal running mode, the time zone setting mode may be obtained as previously described.

Figure 1B:
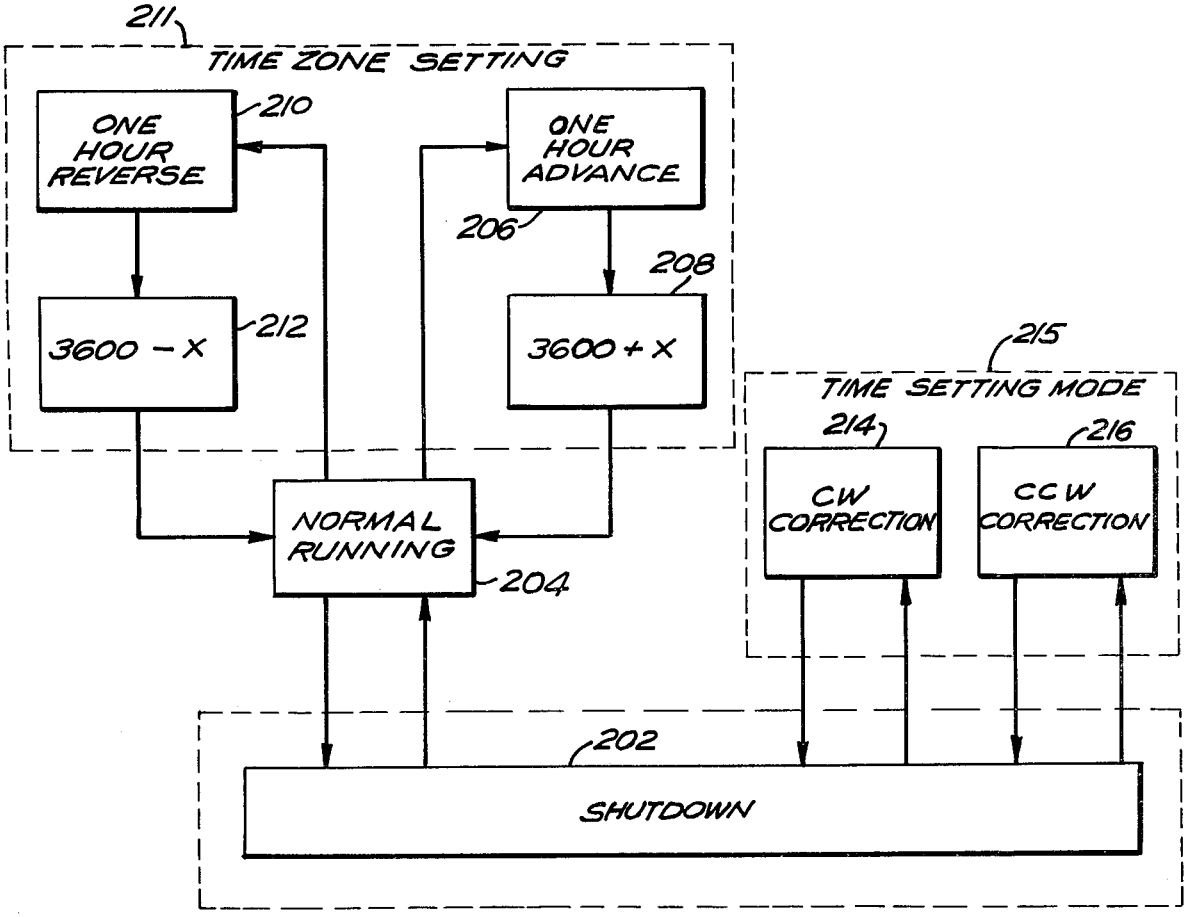
FIG. 1*b* is a block diagram showing the time modes of FIG. 1*a* in relation to the shutdown made in accordance with the preferred embodiment of the invention.

FIG. 1*b* shows timing mode selection sequence 200 for producing time zone changes and time setting changes in the watch using a high speed stepping motor. Timing mode selection sequence 200 include time zone setting 211 and time setting 215. The time zone setting mode is obtained from normal running mode 204. Time zone setting includes one hour reverse time correction 210 and one hour advance time correction 206. One hour reverse time correction is adjusted for the time it takes to rotate, in reverse, the hour hand by one hour 212 before automatically returning to normal running mode 204 and one hour advance time correction is adjusted for the time it takes to rotate, in advance, the hour hand by one hour before automatically returning to normal running mode 204. Time setting mode 215 includes correcting time in the clockwise direction 214 and correcting time in the counterclockwise direction 216. Both time setting mode 215 as well as normal running mode 204 are obtained from shutdown mode 202.

Time zone changes include advancing or reversing time indicating members in one hour intervals. Time setting changes include advancing or reversing time indicating members in one minute intervals. Shutdown mode 202 occurs when switch or crown 42 in FIG. 1*a* is pulled to its out/setting position. By pushing the crown to its on/run position, the watch will be placed in its one-impulse-per-second normal clockwise operating mode 204. To produce a time zone change of one hour advance 206, the crown is rotated clockwise and held in position for more than two seconds while the watch is in its normal running mode. The stepping motor advances or moves forward one of the time indicating members, the hour hand, by one hour. The stepping motor can operate at high speeds up to a frequency of 1,000 Hz. The number of impulses, X, that occur during the time that it takes for the hour hand to be advanced one hour is added to 3,600 impulses or seconds per hour. Once the one hour advance is completed and the time is adjusted 208 to compensate for the length of time required to advance the hour hand, the watch automatically returns to its normal running mode 204. Time correction resulting from a time zone change in the forward direction is completed. A similar operation occurs if it is desirable to provide for time correction by reversing the hour hand by one hour 210. In this case the crown is turned counterclockwise and held in position for more than three seconds. The amount of time that it takes to move the hour hand back by one hour is subtracted from the 3,600 impulses representing seconds per hour 212. The watch then returns to its normal running mode 204 automatically. If more hourly changes are required either to advance or reverse the hour hand to another time zone, the appropriate steps described above are repeated.

If the crown is pulled to its out/setting position, the watch is placed in the shutdown mode 202. Directly from the shutdown mode, the watch can be placed in the time setting mode. If the crown is turned counterclockwise while in its out/setting position, the minute hand is rotated clockwise. Alternatively, if the crown is turned clockwise, the minute hand is rotated counterclockwise. In either case, when the crown is released from its rotated position, the shutdown mode is again obtained.

Figure 2:
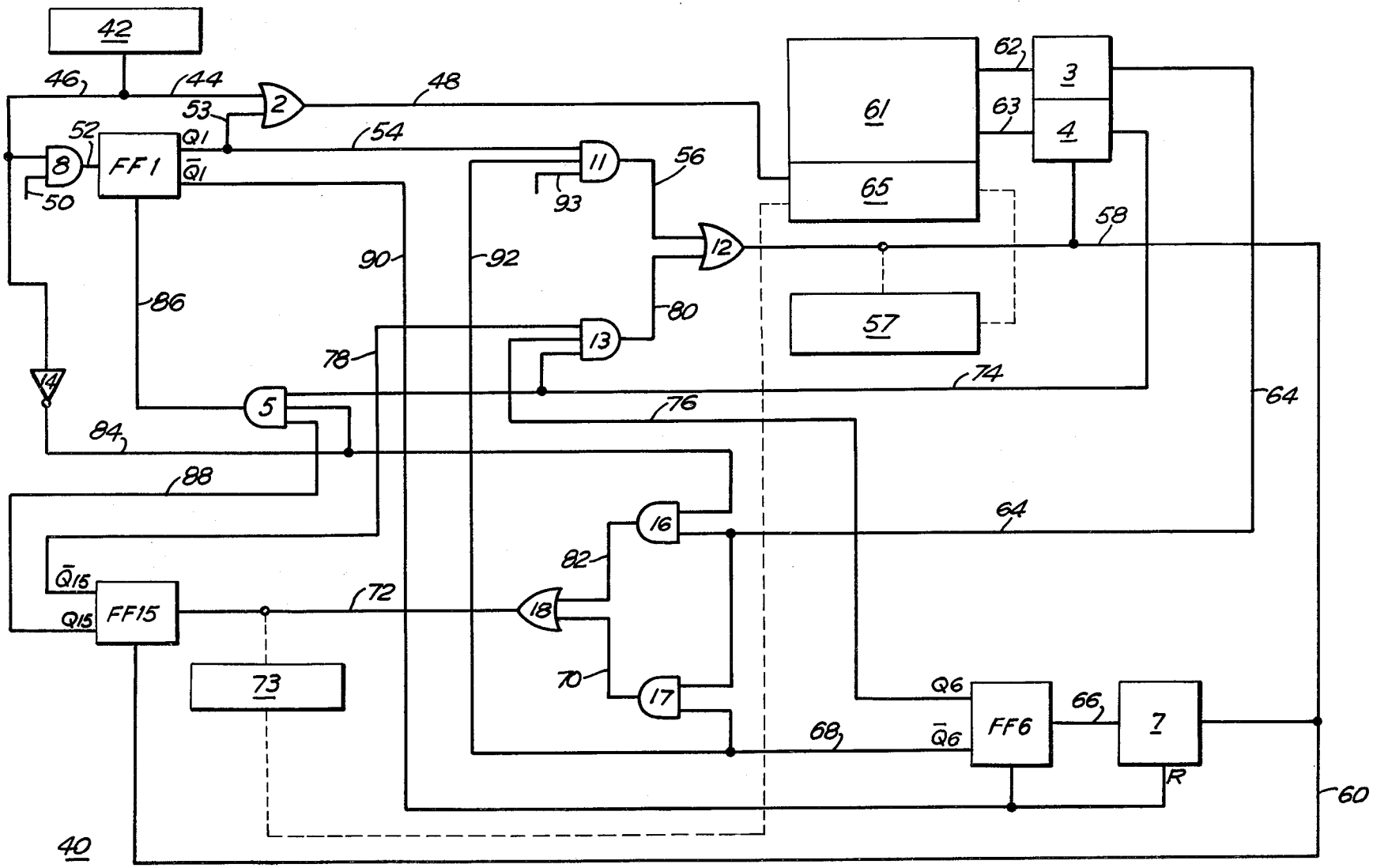
FIG. 2 is a logic circuit diagram showing the time setting mode of FIG. 1*b;*
Figure 3:
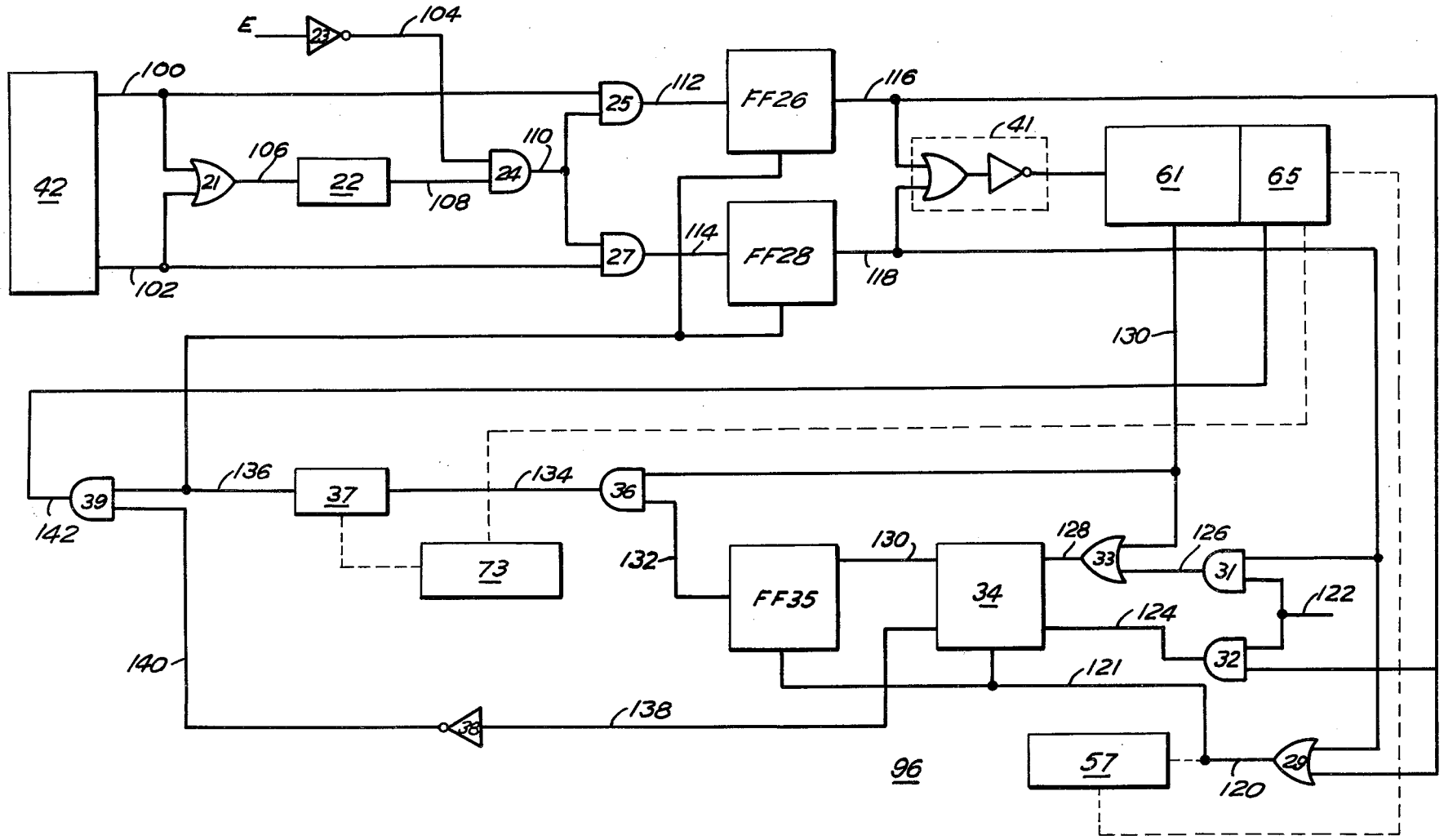
FIG. 3 is a logic circuit diagram showing the time zone mode of FIG. 1*b;*
Figure 5:
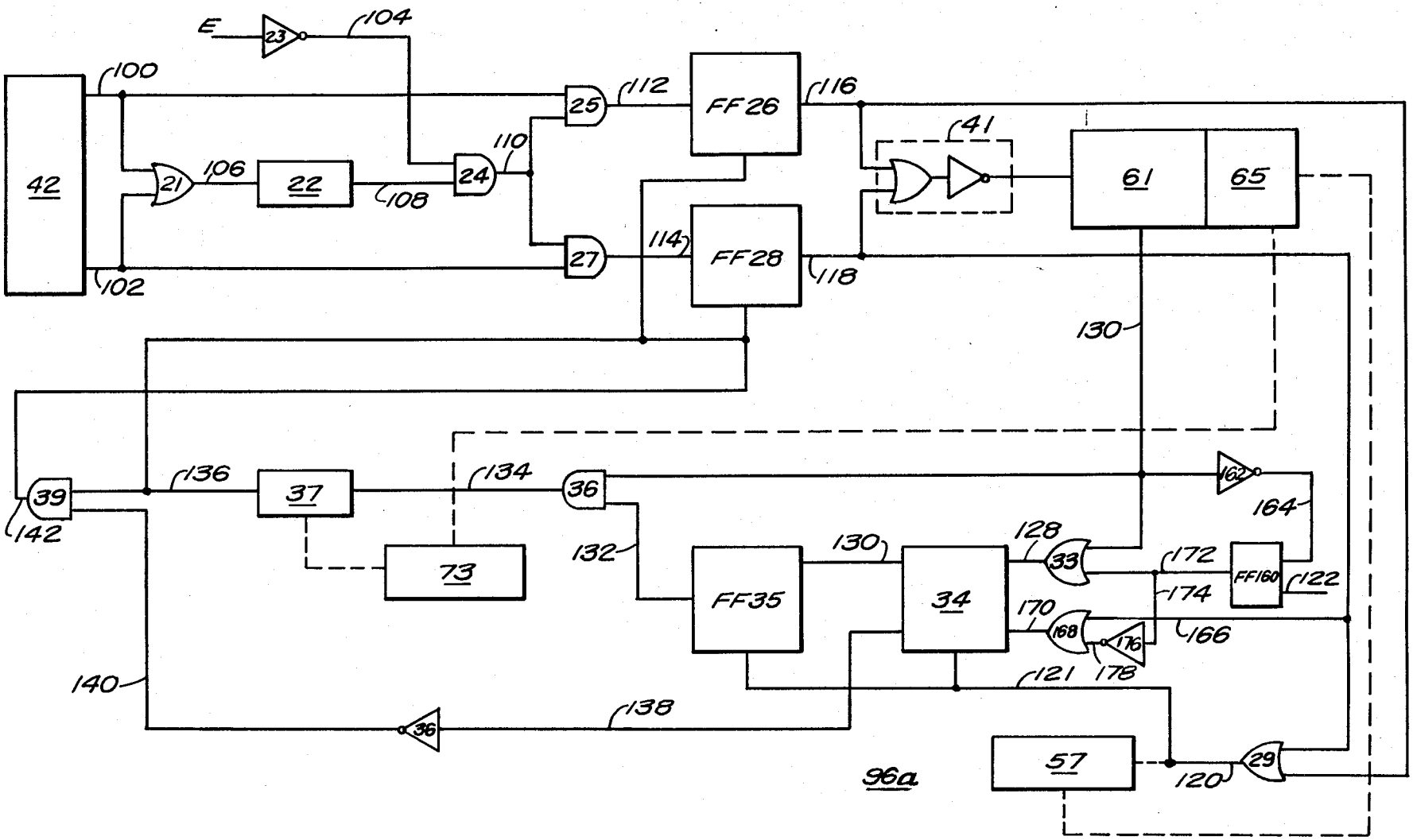
FIG. 5 is a modified logic circuit diagram of FIG. 3

There are two time setting options. The following discussion of the options will be substantially directed to advance or forward time correction. It is understood that the same principles apply to reverse time correction. To implement a first option, another time indicating member, the minute hand, is set by a series of sixty impulses. The minute hand advances step-by-step six times at the rate of one minute each second or at a frequency of 1 Hz. The minute and hour hands are set by at least one series of sixty impulses where the time delay between two series is one second. As shown in FIGS. 2, 3, and 5 and later described, stepping motor controller 65, responsive to movement of crown 42, produces the series of impulses that drive stepping motor 61 to provide for time correction. After advancing six steps, the minute hand then begins to advance automatically at a high rate of speed, which rate is a whole number multiple of sixty impulses, until the crown is released from its rotated position. During the step-by-step movement of the minute hand, the second hand seems to remain at its initial position. At the end of fast movement of the minute hand, the second hand stops at its initial position. Time correction continues until the crown is released from its rotated position.

The second option provides for the minute hand to rotate step-by-step at the rate of one minute each second or at a frequency of 1 Hz, as previously described, until the crown is released from its rotated position. The setting of the hour hand is obtained by putting the watch into the normal running mode directly from the shutdown mode by first pushing the crown to its on/run position and then rotating the crown in the appropriate direction and holding its position for more than two seconds. The second hand seems to remain in the initial position.

FIG. 2 shows time setting circuit 40 of the watch or timepiece. The time setting circuit 40 of the watch or timepiece includes flip-flop (FF) 1 for starting the time setting function in response to axial and rotational movement of crown 42, AND gate 8 for insuring that the crown has been held in its rotated position for a predetermined amount of time, OR gate 2 for inhibiting the 1 Hz pulses to motor controller 65 and stepping motor 61, first and second counters 3 and 4, respectively, that count the number of impulses provided to the stepping motor and third counter 7 which controls decceleration ramp 73 via flip flop 6, AND gate 17 and OR gate 18. When crown 42 is released from its rotated position, deceleration ramp 73 is controlled by second counter 3 via AND gate 16 and OR gate 18. Signals from AND gate 11 and OR gate 12 produce a pulse which resets second and third counters 3 and 4 respectively, control acceleration ramp 57, and reset flip-flop 15 which is activated to one level for the duration of the deceleration ramp 73. Second and third counters 3 and 4 are also reset via AND gate 13 and OR gate 12 when flip-flop 15 changes state indicating that the motor is decelerating and stopping. AND gate 5 resets flip-flop 1 after receiving a signal from inverter 14 that crown 42 has been released from its rotated position.

When crown 42 is pulled to its out/setting position but not rotated, the watch is in the shutdown state. The time setting function is only performed from the shutdown state when the crown is rotated in either the clockwise or counterclockwise direction. Crown 42 is adapted to provide, in a manner known in the art, either high level signals along lines 44 and 46 in order for the time setting circuit to distinguish between clockwise and counterclockwise rotation of the crown in order to initiate appropriate time correction. OR gate 2 receives the signal along line 44 together with start time setting function high level signal Q1 along line 53 from flip-flop 1 for producing an output signal on line 48 which inhibits the 1 Hz pulses to the stepping motor. Inhibiting the 1 Hz pulses to the stepping motor provides for the minute hand to advance one minute per second for six seconds before automatic high speed time correction rotation begins. High speed rotation ends when the crown is released from its rotated position. The second hand will be in its initial position at the end of time correction. The signal along line 46 is applied to AND gate 8 along with a clock signal of constant frequency provided along line 50. AND gate 8 provides the conjunction of both signals for the purpose of determining that the crown has been held in its rotated position for more than two seconds. If the crown has maintained its rotated position for more than two seconds, a high level signal from gate 8 is applied along line 52 to activate flip-flop 1 to start the time setting function. High level signal Q1 from FF1 is applied to gate 2 along line 53 for inhibiting the impulses to the stepping motor as previously indicated. Low output signal $\overline{Q1}$ of FF1 provided along line 90 resets FF6 and third counter 7.

The high level output from FF1 is also provided along line 54 to AND gate 11 once the time setting operation begins. Also applied to gate 11 is a 1 Hz clock signal on line 93 and low level signal $\overline{Q6}$ provided by FF6 along lines 68 and 92. The conjunction of these input signals at gate 11 results in an output signal which is transmitted to OR gate 12 along line 56. The output signal of gate 12 produces a high impulse signal along line 58 to reset first counter 3 and second counter 4. Each impulse signal provided on line 58 increments third counter 7 by one, controls the beginning of acceleration ramp 57 and resets FF15 along line 60. FF15 maintains one level of activation for the duration of the deceleration ramp and switches to another state at the end of the ramp at which time the stepping motor stops.

When counter 3 counts 60−n impulses provided along line 62, that are representative of and in accordance with the number of impulses transmitted to the stepping motor from stepping motor controller 65, and when counter 7 counts less than 7 impulses provided along line 58, i.e. n impulses, the output provided along line 72 from OR gate 18 starts deceleration ramp 73. The deceleration ramp starts n impulses before the actual stopping of the stepping motor. Therefore, if the value of n is 1, the last pulse, before the actual stopping of the motor, is used to decelerate and stop the motor. All pulses before the last one maintain motor rotation. The deceleration ramp control output signal from gate 18 is produced when counter 7, after counting less than 7 impulses, provides a signal along line 66 to activate FF6. Low level output signal $\overline{Q6}$ from FF6 is provided to AND gate 17 along line 68. The output signal from counter 3 is also supplied to gate 17 but along line 64. Gate 17 produces an output signal along line 70 which is applied to OR gate 18. The output signal from gate 18 controls the beginning of the deceleration ramp. The ramp control signal on line 72 is maintained by the state of FF15.

When counter 3 counts 60−n impulses and counter 7 counts seven impulses (n=7) provided along line 58, counter 7 activates the high level output Q6 of FF6 such that counter 3 no longer has any affect on gate 17 while the crown is maintained in its rotated position. At this time, counter 7 essentially clocks FF6. When the crown is released, at the (60−n)th impulse counted by counter 3, the beginning of the deceleration ramp is controlled, as before, by the output signal from gate 18 along line 72. However, the input to gate 18 is now provided by the output of AND gate 16 along line 82. The input to gate 16 is provided by the output of counter 3 along line 64 when the (6−n)th impulse is counted and by the signal along line 84 indicating that the crown has been released. Since the crown, at this point, is no longer held in its rotated position, the low level signal on line 46 is inverted by inverter 14 to a high level signal and then provided along line 84 to gate 16. Gate 16 produces a high level signal along line 82 after receiving both high level signals along line 84 and 64 for the purpose of controlling the beginning of the deceleration ramp.

When counter 4 counts the sixtieth (60th) stepping motor impulse, it provides a signal on line 74 to both AND gate 5 and AND gate 13. A high level output signal is produced from gate 13 on line 80 after gate 13 receives the signal from counter 4, the high level signal from FF6 along line 76 produced when counter 7 obtains a count of 7 and the low level output signal $\overline{Q15}$ along line 78 from FF15. This low level signal indicates that the motor is decelerating and stopping. The signal produced by gate 13 along line 80 is received by OR gate 12 which produces a high level output impulse along line 58 for resetting counters 3 and 4.

When the crown is released and the 60th impulse is counted by counter 4, FF1 is reset by the signal provided along line 86 from AND gate 5. Gate 5 receives the inverted signal along line 84 which indicates that the crown has been released, the high level signal Q15 along line 88 from FF15 which indicates that the deceleration ramp has ended and the signal along line 74 which indicates that the 60th impulse has been counted by counter 4. The output of gate 5 resets FF1 indicating that the time setting operation has ended.

If the crown is released between the (60−n)th and the 60th impulse, no signal is applied to FF15 along line 72 since the stepping motor receives a whole number multiple of 60 additional impulses before stopping to allow the second hand to return to its initial position.

In summary, when the crown is pulled out the watch is in the shutdown state and time setting may be performed by rotating the crown clockwise or counterclockwise. 1 Hz impulses to the motor are inhibited and time setting circuit 40 determines if the crown has been maintained in its rotated position for more than two seconds. Depending upon which way the crown was turned and the amount of time that it was held in the rotated position, the minute hand can move forward or backward by steps of one minute per second for six seconds. The minute hand then automatically rapidly moves forward or backward at high speed which is some multiple of 60 pulses or at a frequency approaching 1,000 Hz until the crown is released from its rotated position. The second hand always stops in its initial position.

FIG. 3 shows time zone circuit 96 of the watch. Time zone circuit 96 includes OR gate 21 and delay 22 for determining that the crown 42 has been held in its rotated position for a predetermined period of time, AND gate 24 for providing a signal to AND gates 25 and 27 indicating that the crown has been held in its rotated position for a predetermined period of time and that no driving impulse is presently being provided to the stepping motor according to the output of inverter 23. Flip-flop 26 or flip-flop 28 will become activated by either gate 25 or gate 27 if crown 42 is turned clockwise or counterclockwise respectively. Output signals from either flip-flop 26 or flip-flop 28 will inhibit the 1 Hz stepping motor impulses via NOR gate 41. OR gate 29 will control acceleration ramp 57 by receiving signals from either FF 26 or flip-flop 28. The acceleration ramp provides for accelerated motor rotation, which rotation is thereafter stabilized towards its maximum value. AND gate 32 provides for fourth counter 34 to count down when the counterclockwise representative signal is supplied from flip-flop 26. Counter 34 is, in this embodiment, a synchronous, up/down counter. AND gate 31 provides for the fourth counter 34 to count up as clockwise representative signals from flip-flop 28 are applied to AND gate 31. OR gate 33 provides for counter 34 to count up, regardless of clockwise or counterclockwise time correction, for each impulse transmitted to stepping motor 61 by motor control 65. After a predetermined number of pulses are counted, FF 35 is activated by fourth counter 34. AND gate 36 which receives the output of flip-flop 35 controls deceleration ramp 73. The deceleration ramp provides for decelerated rotor rotation during which time a deceleration current is applied to the rotor of stepping motor 61. The current provided during rotation is inverted in order to decelerate the rotor. A second delay 37 provides a long duration pulse for the immobilization of the rotor. This pulse may occur just prior to the stopping of the motor when n=1. AND gate 39 provides for one additional clockwise rotation of stepping motor 61 when counter 34 indicates, through inverter 38, that it has not counted a predetermined number of pulses.

Crown 42 is pushed to its on/run position such that the watch is in the normal clockwise running mode at one pulse per second or 1 Hz. The time zone operation is begun by rotating the crown in either the clockwise direction or the counterclockwise direction while the watch is in the normal running mode. A signal is applied to OR gate 21 along line 100, if the crown is rotated in the clockwise direction, and to gate 21 along line 102, if the crown is rotated in the counterclockwise direction. Regardless of the direction in which the crown is rotated, a signal is always applied to gate 21 at the start of the time zone mode. In either rotational case, first delay means 22 receives an output signal from gate 21 along line 106 regardless of the direction of rotation of the crown for the purpose of determining that the crown has been held in its rotated position for more than two seconds.

If a normal 1 Hz impulse is driving the stepping motor at the same time that the time zone function is requested to begin, input E to inverter 23 is high. The circuit waits until the driving impulse is over and until E becomes a low level signal. Input E is inverted by gate 23 and applied to AND gate 24 along line 104. Therefore, when the driving impulse is over and input E is low, gate 24 receives a high level signal because input E is inverted. A high level output signal from delay means 22 is also applied to gate 24, but along line 108, such that the two high level input signals together produce a high level output signal from gate 24 along line 110 to both AND gates 25 and 27. Depending upon which way the crown is turned, either FF26 or FF28 will become activated by output signals from either gate 25 or 27 along lines 112 or 114, respectively. Specifically, if the crown is turned clockwise, FF26 will be activated and if the crown is turned counterclockwise, FF28 will be activated. Either FF26 or FF28 will produce an impulse that is received by OR gate 29 for controlling the beginning of the acceleration ramp. Gate 29 will generate an impulse on line 120 after receiving a clockwise representative signal on line 116 from FF26 or a counterclockwise representative signal on line 118 from FF28. The same output impulse from gate 29 is provided along line 121 to reset fourth counter 34 and to reset FF35.

The signal provided on either line 116 or 118 is applied to NOR gate 41 for the purpose of inhibiting the normal 1 Hz stepping motor impulse during the entire operation of the time zone function. The 1 Hz pulses are used instead for counting up or counting down counter 34, depending upon which way the crown is turned, to provide for time correction.

If the crown is turned in the counterclockwise direction, the stepping motor turns in the clockwise direction and counter 34 counts up all impulses sent to the stepping motor via gate 33. Also, while the crown is turned in the counterclockwise direction, the counterclockwise representative (high level) signal along line 118 produced by FF28 is provided to AND gate 31 in conjunction with the 1 Hz signal on line 122. The output signal produced by gate 31 is provided to OR gate 33 along line 126 and from gate 33 to counter 34 along line 128 for counting up at the rate of one impulse each second. When the crown is turned in the clockwise direction, the stepping motor turns in the counterclockwise direction but counter 34 still counts up all of the impulses sent to the motor. The clockwise representative (high level) signal along line 116 produced by FF26 is provided to AND gate 32 in conjunction with the 1 Hz signal on line 122. FF28 produces a low level signal on line 118 during the 3600 impulses. An output signal from gate 32 is provided to counter 34 along line 124 for counting down at the rate of one impulse per second while the crown is turned in the clockwise direction. Counter 34 always counts up the number of impulses transmitted to stepping motor 61 by receiving those impulses along line 128 from OR gate 33. Gate 33 receives the stepping motor impulses along line 130. Therefore, regardless of the rotation of the crown, counter 34 counts up each impulse transmitted to the motor and counts up or down each pulse provided by the 1 Hz signal at a rate of one impulse per second for as long as the crown is held in the counterclockwise or clockwise position respectively.

The beginning of the deceleration ramp is controlled by AND gate 36 which receives both the impulses transmitted to the motor on line 130 and the output of FF35 on line 132. Flip-flop 35 is activated by a signal provided on line 130 when counter 34 obtains the (3600−n)th impulse. The output of gate 36 is provided along line 134 to second delay means 37 for the purpose of starting the deceleration ramp n units of time before the time zone function stops. The deceleration ramp reduces the fast time correction speed prior to the end of the time correction function. The second delay means produces an impulse on line 136 at the end of deceleration to reset FF26 and FF28 when the watch function returns to the normal running mode. Second delay means 37 provides a time delay that lasts for the duration of the deceleration ramp.

If counter 34 counts a 1 Hz impulse to the motor during the deceleration or delay time, the counter will not have a count of 3,600 at the end of the deceleration ramp. Therefore, a low level output signal will be produced by counter 34 along line 138 to inverter 38. The inverter will provide a high level signal on line 140 to AND gate 39. The impulse generated by second delay means 37 is provided in conjunction with the inverted signal on line 140 for the purpose of generating one clockwise rotation signal at the output of gate 39 on line 142. Otherwise, when counter 34 obtains a count of 3,600 a high level pulse on line 138 will be inverted by invertor 38 to a low level pulse on line 140 such that no clockwise pulse will be provided to the stepping motor at the output of gate 39.

In summary, the automatic time zone operation starts from the normal clockwise running mode when the crown is rotated either clockwise or counterclockwise and held in position for a predetermined period of time. If the stepping motor is being driven at the same time that the time zone function is to begin, time zone circuit 96 will wait until the motor is no longer being driven. Regardless of which way the crown is rotated, the time zone function circuit starts an acceleration ramp, resets a counter, and inhibits the 1 Hz signal provided to the stepping motor. The 1 Hz signal is used instead for counting up or counting down to provide time correction. Rotating the crown clockwise will turn the stepping motor in the counterclockwise direction and vice versa, the counter will count up each pulse transmitted to the motor, and the counter will either count up or count down depending upon whether the stepping motor turns in the clockwise or counterclockwise direction respectively. The deceleration ramp begins when the counter counts the (3,600−n)th impulse and the watch returns to the normal running mode at the end of deceleration. If the counter counts a 1 Hz impulse to the motor during the deceleration ramp, the count of 3,600 will not be obtained such that the stepping motor will be provided with one pulse for clockwise rotation. The amount of time required to make the correction will either be added to or substracted from 3,600 in order to account for the time required for the correction to occur.

FIG. 5 shows time zone circuit 96*a* which is a slightly modified embodient of the time zone circuit shown in FIG. 3. Since the modifications are minimal, only the changes made to time zone circuit 96 to produce circuit 96*a* will be discussed with the understanding that all other components in FIG. 5 are as described in FIG. 3.

Stepping motor impulses are provided along line 130 to gate 33 just as in the circuit of FIG. 3, but, in addition, are provided to FF160 via inverter 162 along line 164. Also provided to FF160 along line 122 are 1 Hz signals.

When the crown is turned counterclockwise, FF28 provides a high level signal along lines 118 and 166 through OR gate 168 and on line 170 to counter 34. This high level signal drives counter 34 to count up. In other words, the UP/DOWN input is provided with a logic level 1 on line 170 so that the counter adds or counts up.

When the crown is turned clockwise, FF28 provides a low level signal along lines 118 and 166 to OR gate 168. However, the signal provided by FF160 along lines 172 and 174 through inverter 176 and along line 178 to gate 168 is a high level signal during the 3600 impulses. Therefore, counter 34 counts up. With each 1 Hz impulse provided along line 122 to FF160, the output becomes a low level signal (logic level 0) such that counter 34 subtracts or counts down one impulse each second.

One clockwise rotation signal is provided on line 142 from gate 39 to reset FF28.

The overall idea is, of course, to provide a logic level 1 on line 170 to activate counter 34 to count up or a logic level 0 on line 170 to activate counter 34 to count down.

Figure 4:
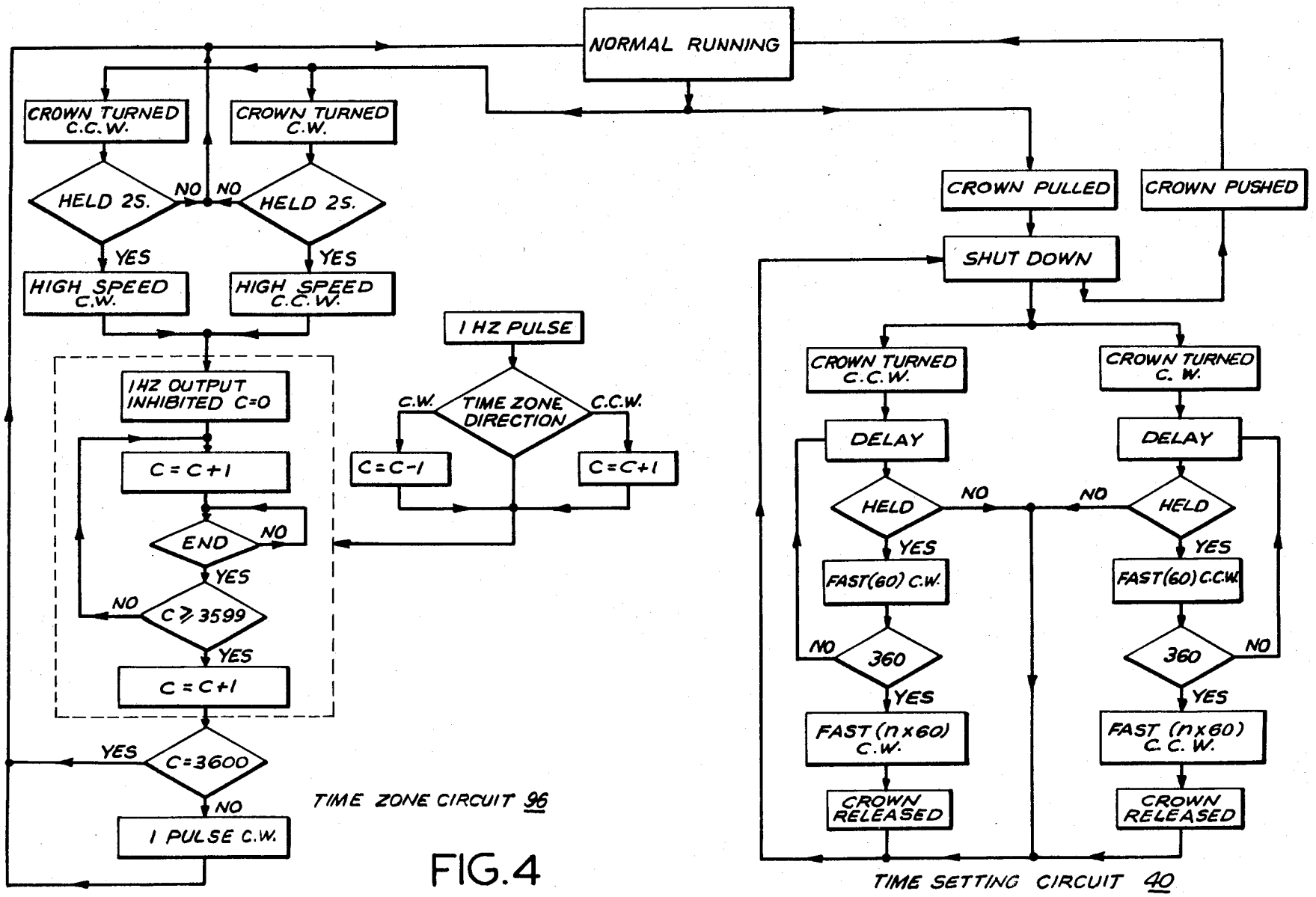
FIG. 4 is a flow chart showing the logic sequences of the time setting mode and time zone mode of FIGS. 2 and 3.

FIG. 4 is a flow chart summarizing the logical sequences of the time zone and time setting functions previously described for producing time correction. Each logical step in the flow chart should, at this point, be self-explanatory in view of the prior discussion of the time correction modes.

What is claimed is:

1. An electronic analog timepiece having a plurality of time correction circuits each providing time correction signals for producing alternately clockwise and counterclockwise time correction rotation of at least one time indicating member when the timepiece is in one of a plurality of operating modes comprising:

(a) switch means for independently selecting one of said operating modes for controlling said time correction circuits for producing said time correction signals, (b) motor control means responsive to said time correction signals for producing at least one series of impulse signals, (c) a high speed stepping motor capable of operating at a speed of as high as 1,000 Hz electrically coupled to said switch means and responsive to said impulse signals from said motor control means for producing high frequency pulsed signals to provide time correction rotation of at least one time indicating member, (d) deceleration ramp means electrically coupled to said stepping motor and responsive to said time correction signals for reducing the speed of said high speed motor, and (e) counter means electrically coupled to said deceleration ramp means and responsive to said impulse signals from said motor control means for starting said deceleration ramp prior to the stopping of said high speed stepping motor.

2. The electronic analog timepiece of claim 1 in which an acceleration ramp automatically increases the speed of said high speed stepping motor after at least one time indicating member rotates slowly for a predetermined number of steps to provide for faster time correction rotation of the same time indicating member.

* * * * *